US012497797B2

(12) United States Patent
Fuller et al.

(10) Patent No.: US 12,497,797 B2
(45) Date of Patent: Dec. 16, 2025

(54) NATURAL DISASTER SHELTER/PRE-FABRICATED HOUSE

(71) Applicants: John W. Fuller, Dripping Springs, TX (US); Bernardo Gomez-Gonzalez, Mexico City (MX)

(72) Inventors: John W. Fuller, Dripping Springs, TX (US); Bernardo Gomez-Gonzalez, Mexico City (MX)

( * ) Notice: Subject to any disclaimer, the term of this patent is extended or adjusted under 35 U.S.C. 154(b) by 164 days.

(21) Appl. No.: 18/114,713

(22) Filed: Feb. 27, 2023

(65) Prior Publication Data

US 2023/0272637 A1 Aug. 31, 2023

Related U.S. Application Data

(60) Provisional application No. 63/314,839, filed on Feb. 28, 2022.

(51) Int. Cl.
*E04H 9/02* (2006.01)
*E04C 5/08* (2006.01)
*E04H 9/14* (2006.01)

(52) U.S. Cl.
CPC ..... *E04H 9/029* (2013.01); *E04C 5/08* (2013.01); *E04H 9/14* (2013.01)

(58) Field of Classification Search
CPC .. E04H 9/29; E04H 9/14; E04H 9/145; E04B 1/3445; E04B 1/34336; E04C 5/08
USPC ..... 52/302.1, 223.1
See application file for complete search history.

(56) References Cited

U.S. PATENT DOCUMENTS

| | | | | | |
|---|---|---|---|---|---|
| 5,729,950 | A * | 3/1998 | Hardy | E04H 9/14 | 52/645 |
| 6,131,343 | A * | 10/2000 | Jackson, Jr. | E04H 9/14 | 52/745.07 |
| 6,393,776 | B1 * | 5/2002 | Waller | E04H 9/14 | 52/741.12 |
| 8,621,789 | B2 * | 1/2014 | Trochan | E04H 9/14 | 52/80.1 |
| 8,910,436 | B2 * | 12/2014 | Carbonaro | E04B 1/26 | 52/506.05 |
| 9,103,110 | B1 * | 8/2015 | Gerber | E04C 2/38 | |
| 9,316,015 | B1 * | 4/2016 | Elliott | E04B 1/98 | |
| 9,850,673 | B1 * | 12/2017 | Hudlow | E04H 9/14 | |
| 10,480,176 | B2 * | 11/2019 | Unger | E04B 1/19 | |
| 10,612,233 | B1 * | 4/2020 | Yu | E04B 1/34321 | |
| 11,242,693 | B1 * | 2/2022 | Galindo | E04B 1/08 | |
| 2008/0017229 | A1 * | 1/2008 | Brewin | E04B 1/169 | 52/2.25 |
| 2008/0245025 | A1 * | 10/2008 | Slater | E04C 3/32 | 52/696 |
| 2012/0079776 | A1 * | 4/2012 | Beattie | E04B 1/26 | 52/653.1 |
| 2012/0255469 | A1 * | 10/2012 | Schilling | E04H 9/029 | 109/1 S |

(Continued)

*Primary Examiner* — Paola Agudelo
(74) *Attorney, Agent, or Firm* — DITTHAVONG. STEINER & MLOTKOWSKI

(57) ABSTRACT

A natural disaster shelter includes light weight steel profile prefabricated field assembled frames, recycled plastic membrane separators and an impregnated cloth membrane or other structural membrane covering on all exposed surfaces of the structure including foundation and roof. A method of forming a natural disaster shelter and a kit of parts for forming a natural disaster shelter are also provided.

11 Claims, 4 Drawing Sheets

(56) References Cited

U.S. PATENT DOCUMENTS

| | | | | |
|---|---|---|---|---|
| 2012/0304589 | A1* | 12/2012 | Commins | E04B 1/2604 52/745.21 |
| 2013/0118097 | A1* | 5/2013 | Kaiser | E04H 9/029 52/745.02 |
| 2015/0093535 | A1* | 4/2015 | Lambach | B29C 44/12 52/745.1 |
| 2016/0010355 | A1* | 1/2016 | Bellve | E04H 9/024 52/79.5 |
| 2018/0340326 | A1* | 11/2018 | Pirrung | E04B 1/61 |
| 2022/0154459 | A1* | 5/2022 | Bond | E04B 2/845 |

* cited by examiner

NATURAL DISASTER SHELTER/PRE-FABRICATED HOUSE

CROSS REFERENCE TO RELATED APPLICATIONS

This application claims the benefit of U.S. Provisional Application No. 63/314,839 filed Feb. 28, 2022, the contents of which are hereby incorporated by reference in their entirety.

FIELD OF THE INVENTION

A lightweight prefabricated structure made of lightweight cold rolled steel standard structural elements, formed into hollow wall panels made of recycled plastic separator vanes and covered with a flexible impregnated cloth membrane or other structural membrane, forming a rectangular structure (e.g. 26 ft×29 ft) based on a flexible geo-membrane foundation with a post tensed tensor mesh reinforced membrane roof, consequentially a shelter or a house.

BACKGROUND OF THE INVENTION

In certain geographical regions having frequent seismic, tornado and/or hurricane activity, it would be desirable to have available a structure to act as a shelter or a house that would resist these natural disaster activities by having the structural capacity to totally resist any of these natural destructive forces.

To date, there has been no total constructive technique of any material or combinations of materials, that will resist a tornado EF4 of the FUJITA Scale, hurricane winds category 5 SAFFIR-SAMPSON and seismic loads of High Risk Zone Site Class F of ASCE.

SUMMARY OF THE INVENTION

In one aspect, provided is a natural disaster shelter comprising: light weight steel prefabricated field assembled frames, including perimeter ground beams, and vertical light weight steel corner and central columns integrated with the ground beams to form wall units; a geo-membrane foundation structurally integrated with the ground beams; plastic wall separators attached transverse to and between the steel columns; and an impregnated cloth membrane covering on all surfaces of the structure, including the foundation and a roof.

In another form the light weight steel frames can be cold rolled steel frames structurally integrated by means of post tensioned tensors connected between the ground beams and columns.

In another form the natural disaster shelter further comprises wall spaces created by the wall separators and surfaced/covered with the impregnated cloth membrane.

In another form the shelter can be a stand-alone structure or is incorporated within a complete house as a safety core, as a kitchen, a bathroom or a reduced emergency living space.

Advantageously the shelter can be incorporated with one or more shelter modules into a school or a community shelter.

In another aspect, provided is a method of forming a natural disaster shelter. The method includes providing a light weight steel prefabricated field assembled frames, including perimeter ground beams, and vertical light weight steel corner and central columns integrated with the ground beams to form wall units; providing a geo-membrane foundation structurally integrated with the ground beams; providing a plastic wall separators attached transverse to and between the steel columns; and providing an impregnated cloth membrane covering on all surfaces of the structure, including the foundation and a roof.

In some forms, the light weight steel frames are cold rolled steel frames structurally integrated by means of post tensioned tensors connected between the ground beams and columns.

In some forms, the method further includes providing wall spaces created by the wall separators and surfaced/covered with the impregnated cloth membrane.

In some forms, the shelter is a stand-alone structure or is incorporated within a complete house as a safety core, as a kitchen, a bathroom or a reduced emergency living space.

In some forms, the shelter is incorporated with one or more shelter modules into a school or a community shelter.

In some forms, the plastic wall separators are made of recycled plastic.

In another aspect, provided is a kit of parts for forming a natural disaster shelter. The kit of parts includes a light weight steel prefabricated field assembled frames, including perimeter ground beams, and vertical light weight steel corner and central columns integrated with the ground beams to form wall units; a geo-membrane foundation structurally integrated with the ground beams; plastic wall separators attached transverse to and between the steel columns; and an impregnated cloth membrane covering on all surfaces of the structure, including the foundation and a roof.

In some forms, the lightweight steel frames are cold rolled steel frames structurally integrated by means of post tensioned tensors connected between the ground beams and columns.

BRIEF DESCRIPTION OF THE DRAWINGS

The present disclosure is susceptible to various modifications and alternative forms, specific exemplary implementations thereof have been shown in the drawings and are herein described in detail. It should be understood, however, that the description herein of specific exemplary implementations is not intended to limit the disclosure to the particular forms disclosed herein.

DETAILED DESCRIPTION OF THE INVENTION

Figure 1:
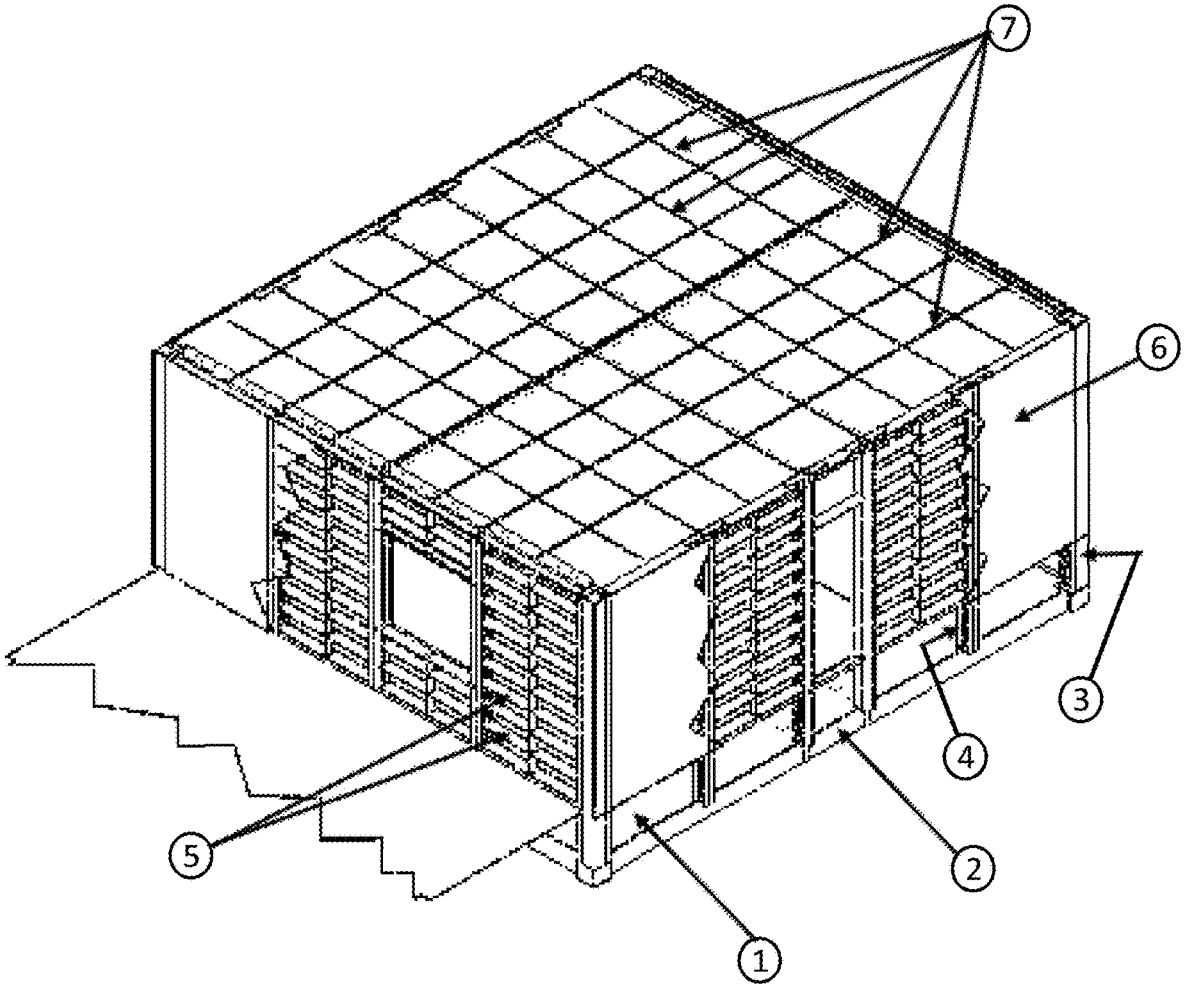
FIG. 1 Is a perspective view of the shelter or prefabricated house according to the present invention.

Various aspects will now be described with reference to specific forms selected for purposes of illustration. It will be appreciated that the spirit and scope of the apparatus, system and methods disclosed herein are not limited to the selected forms. Moreover, it is to be noted that the figures provided herein are not drawn to any particular proportion or scale, and that many variations can be made to the illustrated forms.

Each of the following terms written in singular grammatical form: "a," "an," and "the," as used herein, may also refer to, and encompass, a plurality of the stated entity or object, unless otherwise specifically defined or stated herein, or, unless the context clearly dictates otherwise. For example, the phrases "a device," "an assembly," "a mechanism," "a component," and "an element," as used herein, may also refer to, and encompass, a plurality of devices, a plurality of assemblies, a plurality of mechanisms, a plurality of components, and a plurality of elements, respectively.

Each of the following terms: "includes," "including," "has," "having," "comprises," and "comprising," and, their linguistic or grammatical variants, derivatives, and/or conjugates, as used herein, means "including, but not limited to."

It is to be understood that the various forms disclosed herein are not limited in their application to the details of the order or sequence, and number, of steps or procedures, and sub-steps or sub-procedures, of operation or implementation of forms of the method or to the details of type, composition, construction, arrangement, order and number of the system, system sub-units, devices, assemblies, sub-assemblies, mechanisms, structures, components, elements, and configurations, and, peripheral equipment, utilities, accessories, and materials of forms of the system, set forth in the following illustrative description, accompanying drawings, and examples, unless otherwise specifically stated herein. The apparatus, systems and methods disclosed herein can be practiced or implemented according to various other alternative forms and in various other alternative ways.

It is also to be understood that all technical and scientific words, terms, and/or phrases, used herein throughout the present disclosure have either the identical or similar meaning as commonly understood by one of ordinary skill in the art, unless otherwise specifically defined or stated herein. Phraseology, terminology, and, notation, employed herein throughout the present disclosure are for the purpose of description and should not be regarded as limiting.

The present invention relates to a natural disaster shelter composed of light weight steel profile prefabricated field assembled frames, recycled plastic membrane separators and an impregnated cloth membrane or other structural membrane covering on all exposed surfaces of the structure including foundation and roof.

The embodiment of this invention is the integration of conventional construction elements configured and structurally assembled to make most efficient use of each of the elements particular characteristics obtaining a high degree of integrated structural efficiency. Basically a frame of lightweight cold rolled steel frames structurally integrated by means of post tensioned tensors, wall space created using recycled plastic extruded separator vanes and surfaced/covered with a flexible impregnated concrete cloth or other structural membrane. The design utilizes the dead weight as a stabilizer the backfilled foundation, structurally integrated using a geo-membrane on a post-tensioned steel mesh to the columns and thereby integrating the whole structure.

Upon termination of the wall assemblies, including the placing and bolting into place of the recycled plastic separator vanes, the wall frames assembled are then located to form the four corners, at 90 degrees, and are united or tied together with duct guided tensors or tendons that are post-tensed to an established torque. The pre-dimensioned impregnated membrane or other structural membrane is placed, bolted into place and duly hardened/stiffened. The final step being the placement of the roofing tensors or tendons, the roofing membrane and the post tensing of the steel mesh tensors or tendons forming the reinforced roof membrane.

Advantageously, the prefabricated shelter/house of the present invention is pre-fabricated of light weight easy to handle structural elements as compared to all traditional construction be it wood or masonry. Additionally, the design is such that it can resist tornados above an EF4 on the Fujita Scale (275 mph winds), hurricanes of Category 5 in the Saffir-Simpson Scale (200 mph winds) and earthquakes/seismic load of intensity XI Mercali Scale. The design is a self-built system from a factory-made kit and may be built into a complete house or simply a safety core housing kitchen, a bathroom and a reduced emergency living space to seek refuge during and post the natural disaster. The modular design permits it to be joined to another such module, as size may require, to create a school or a community shelter or center.

FIG. 1 illustrates the structure with its principal components and their integrated assembly. A geo-membrane foundation (1) is structurally integrated to a perimeter ground beam (2) by means of a lattice of post tensioned tendons (8). Corner columns (3) are attached to the perimeter ground beam (2), along with intermediate column/struts (4) that vertically form the wall units and are also attached to the perimeter ground beam (2) at one end and upper support members at the opposite end. Spaced wall separators (5) are inserted transversely between the corner columns (3) and intermediate columns (4) and covered with a flexible impregnated cloth (6) or other structural membrane attached to form a hollow wall made of extruded plastic separators. The flexible impregnated cloth can be Concrete Canvas as disclosed in U.S. Published Application No. 2011/0311755 A1, incorporated herein by reference in its entirety, or other structural membrane internal and external wall surface membrane. A roof lattice (7) of post tensioned tendons that hold the roof membrane in place and resist the wind suction forces (tornado), additionally a secondary inferior support lattice of light structural elements to eliminate the membranes deflection from its own weight, structural elements defined strictly by dimension of the roof dimensions.

Figure 2:
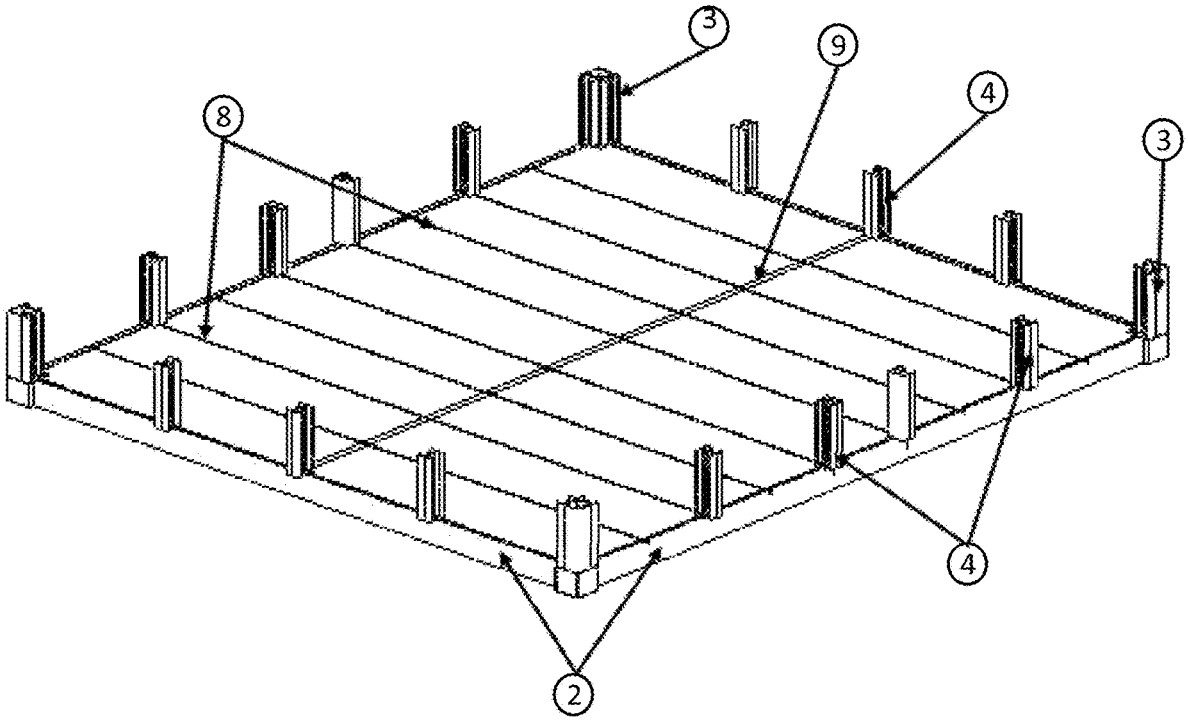
FIG. 2 is a perspective view of the foundation of the shelter/house.

FIG. 2 illustrates the foundation of the structure which is principally formed by post tensioned tensors or tendons (8) and one or more stiffening separator ground beams (9) on which the geo-membrane is supported. The perimeter ground beam (2), the corner columns (3) and central or intermediate column/struts (4) are connected to the perimeter ground beam and rise upward to the super structure. The corner column footings are placed followed by the perimeter ground beams (2), which are then fastened to the corner footings by means of a post tensioned tensor running from one corner footing to the next. These are then post tensed to the established tension.

Figure 3:
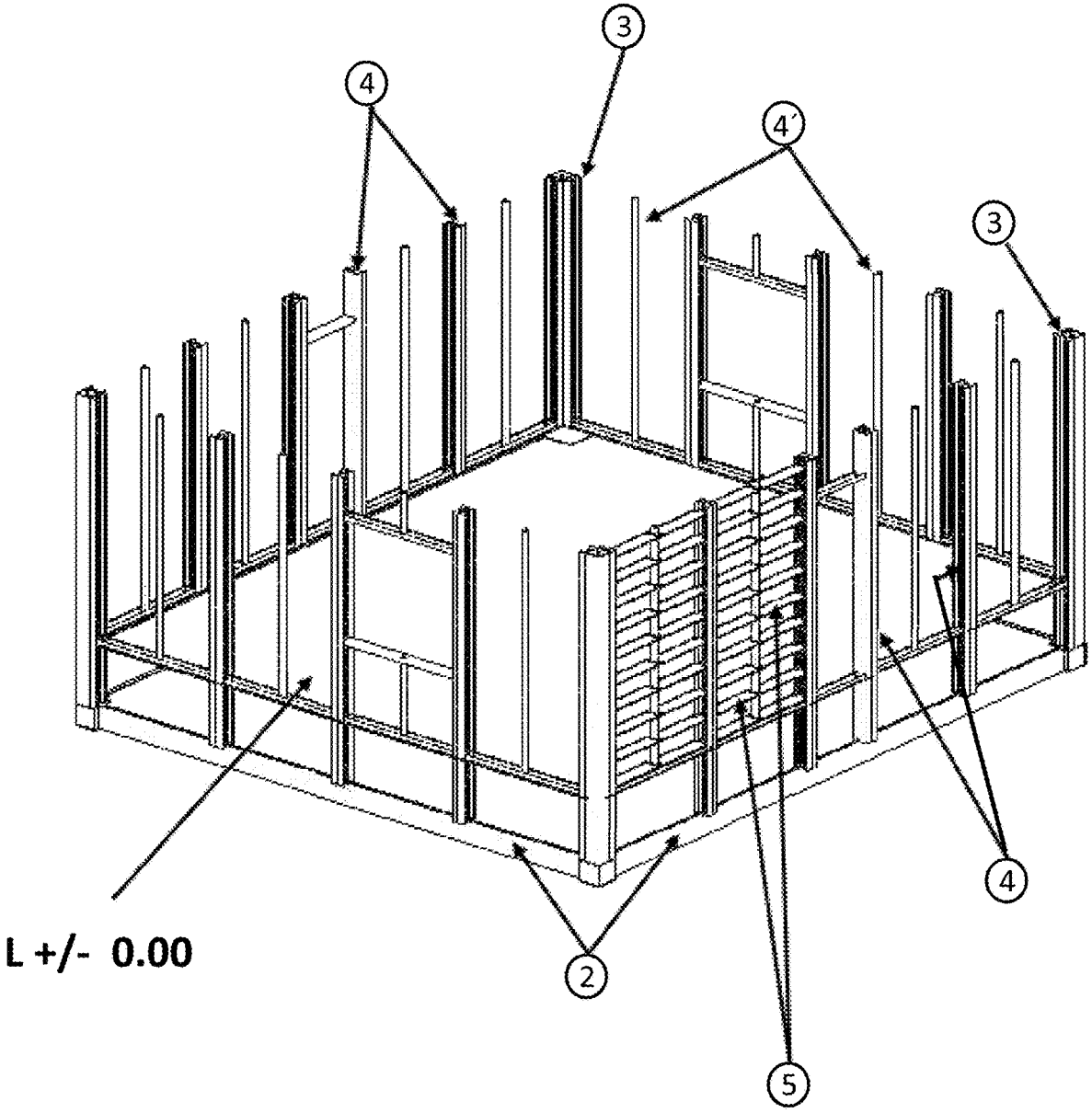
FIG. 3 is a perspective view of the columns, corner and intermediate, from the foundation level up.

FIG. 3 illustrates the entire structure, from foundation to roof line, and the principal structural elements that make up the overall structure. The perimeter ground beams (2), corner columns (3), intermediate columns (4), secondary vertical elements-wall panel centerpieces (4') and support of PET surface separator vanes and a sample of installed wall surface separators (5). Secondary vertical elements (4') from ground level to roof serve as stiffeners and connectors to the extruded recycled wall surface separators (5). A serviceable flooring may be poured concrete or a concrete membrane.

Figure 4:
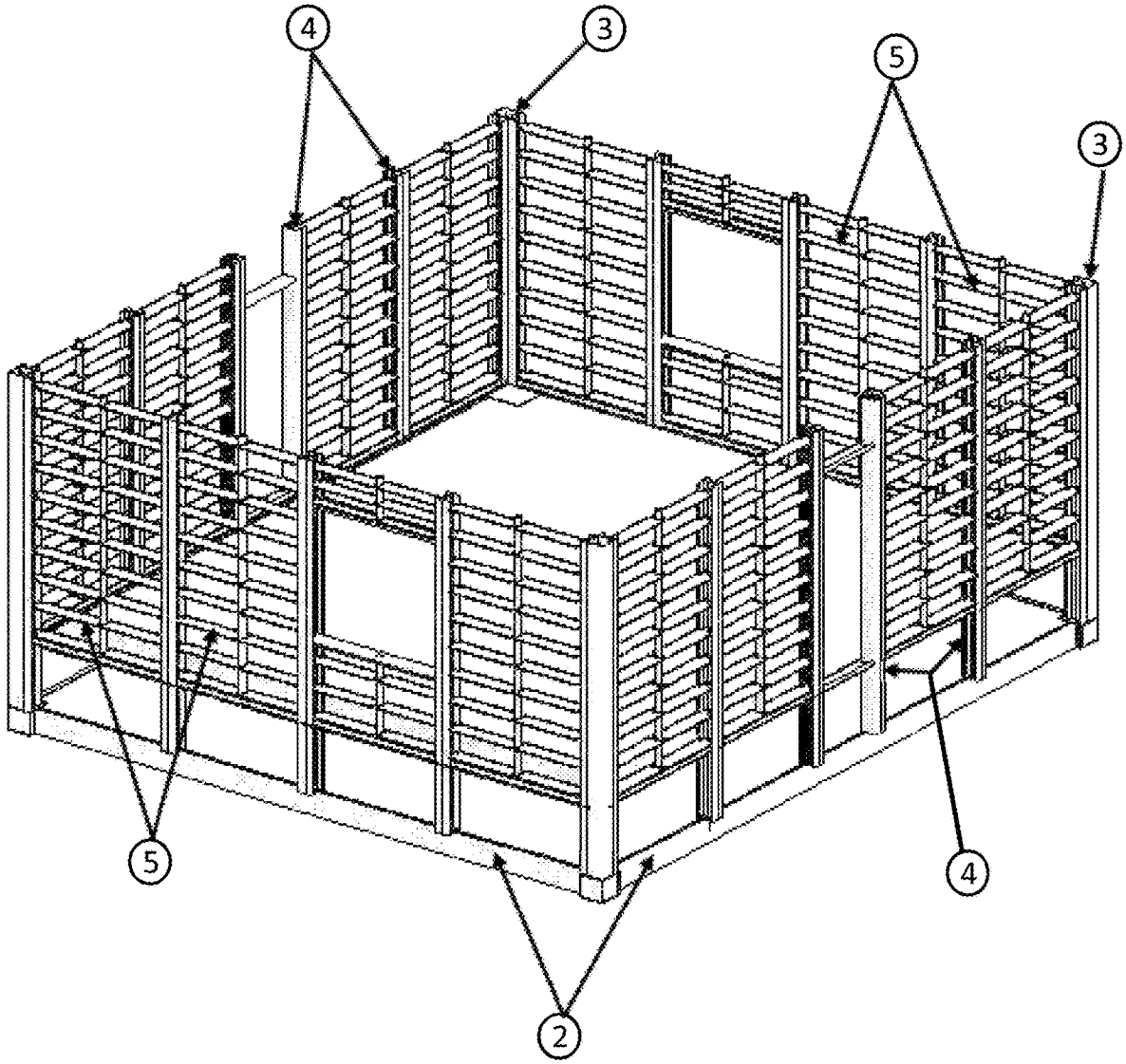
FIG. 4 is a perspective view, that demonstrates all of the perimeter walls.

FIG. 4 illustrates the entire structure, from foundation to roof—as per FIG. 3, with the addition of the wall unit surface separators (5) made of recycled extruded plastic. The perimeter ground beams (2), corner columns (3), intermediate columns (4), secondary vertical elements-wall panel centerpieces (4') and support of PET surface separator vanes are illustrated as a unit or module.

The systems and methods disclosed herein are applicable to the building and construction industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed:

1. A natural disaster shelter comprising:

lightweight steel prefabricated field assembled frames, including perimeter ground beams, and vertical light weight steel corner and central columns integrated with the ground beams to form wall units;

a geo-membrane foundation structurally integrated with the ground beams;

plastic wall separators attached transverse to and between the steel columns; and an impregnated cloth membrane covering on all surfaces of the structure, including the foundation and a roof, wherein the lightweight steel frames are cold rolled steel frames structurally integrated by means of tensors or tendons connected between the ground beams and columns.

2. The natural disaster shelter of claim 1, further comprising wall spaces created by the wall separators and surfaced/covered with the impregnated cloth membrane.

3. The natural disaster shelter of claim 1, wherein the shelter is a stand-alone structure or is incorporated within a complete house as a safety core, as a kitchen, a bathroom or a reduced emergency living space.

4. The natural disaster shelter of claim 1, wherein the shelter is incorporated with one or more shelter modules into a school or a community shelter.

5. The natural disaster shelter of claim 1, wherein the plastic wall separators are made of plastic.

6. A method of forming a natural disaster shelter, comprising:

providing lightweight steel prefabricated field assembled frames, including perimeter ground beams, and vertical lightweight steel corner and central columns integrated with the ground beams to form wall units;

providing a geo-membrane foundation structurally integrated with the ground beams;

providing plastic wall separators attached transverse to and between the steel columns; and providing an impregnated cloth membrane covering on all surfaces of the structure, including the foundation and a roof, wherein the lightweight steel frames are cold rolled steel frames structurally integrated by means of tensors or tendons connected between the ground beams and columns.

7. The method of claim 6, further comprising providing wall spaces created by the wall separators and surfaced/covered with the impregnated cloth membrane.

8. The method of claim 6, wherein the shelter is a stand-alone structure or is incorporated within a complete house as a safety core, as a kitchen, a bathroom or a reduced emergency living space.

9. The method of claim 6, wherein the shelter is incorporated with one or more shelter modules into a school or a community shelter.

10. The method of claim 6, wherein the plastic wall separators are made of plastic.

11. A kit of parts for forming a natural disaster shelter, comprising:

lightweight steel frames configured to be field assembled, wherein the lightweight steel frames include perimeter ground beams, and vertical lightweight steel corner and central columns configured to be integrated with the ground beams to form wall units;

a geo-membrane foundation configured to be structurally integrated with the ground beams;

plastic wall separators configured to be attached transverse to and between the steel columns; and an impregnated cloth membrane configured to cover all surfaces of the structure, including the foundation and a roof, wherein the lightweight steel frames are cold rolled steel frames configured to be structurally integrated by means of tensors or tendons configured to be connected between the ground beams and columns.

* * * * *